United States Patent [19]

Smith

[11] Patent Number: 4,485,917

[45] Date of Patent: Dec. 4, 1984

[54] HAND WEARING APPAREL DISPLAY PACKAGE AND METHOD AND MACHINE FOR ASSEMBLY THEREOF

[75] Inventor: Jasper N. Smith, Buffalo Grove, Ill.

[73] Assignee: Wells Lamont Corporation, Chicago, Ill.

[21] Appl. No.: 357,582

[22] Filed: Mar. 12, 1982

[51] Int. Cl.[3] ..... B65D 31/00

[52] U.S. Cl. ..... 206/278; 206/216; 206/281; 206/806

[58] Field of Search ..... 206/278, 806, 216, 281, 206/294, 459, 526, 593; 40/2 R, 40 R; 223/85, 87

[56] References Cited

U.S. PATENT DOCUMENTS

| | | | |
|---|---|---|---|
| 2,682,122 | 6/1954 | Hanson | 206/278 |
| 2,732,934 | 1/1956 | Hall | 206/278 |
| 2,995,845 | 8/1961 | Fraser | 206/278 |
| 3,132,742 | 5/1964 | Shapiro et al. | 206/278 |
| 3,144,721 | 8/1964 | Woloz | 206/278 |
| 3,414,175 | 12/1968 | Brosk | 206/278 |
| 3,670,947 | 6/1972 | Tangredi et al. | 206/278 |
| 4,189,049 | 2/1980 | Silver | 206/806 |
| 4,201,299 | 5/1980 | Bumgarner et al. | 206/806 |

*Primary Examiner*—Joseph Man-Fu Moy
*Assistant Examiner*—David Fidei
*Attorney, Agent, or Firm*—Emrich & Dithmar

[57] ABSTRACT

A hand wearing apparel display package is comprised of left-hand and right-hand apparel members superimposed with respect to each other with the palm facing the back, a hanger member positioned adjacent the back panel along the open ends, a labeling tag positioned on the outside surface of the hanger member and fastening means extending through the hand wearing apparel members through the hanger member and the labeling tag to complete the display package. Additionally, an apparatus for assembling the hand wearing apparel display package is comprised of a rotatable housing having a first work station adapted to receive the labeling tag, a second work station cooperating with the hanger member dispenser for depositing the hanger member onto the labeling tag and a third fastening work station wherein the hand wearing apparel display package is fastened together.

5 Claims, 7 Drawing Figures

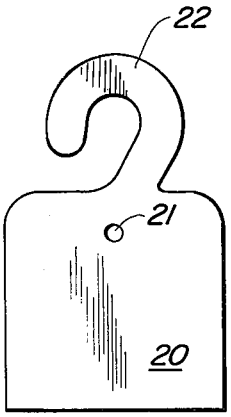
FIG-2a
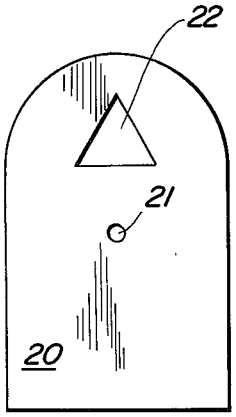
FIG-2b
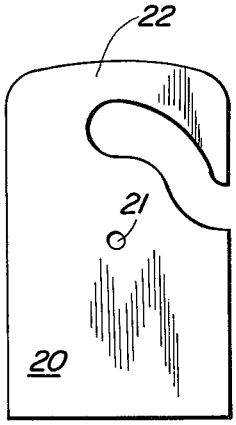
FIG-2c
FIG-3a
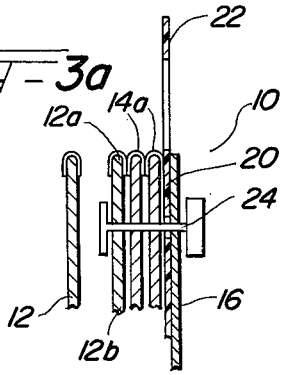
FIG-3b
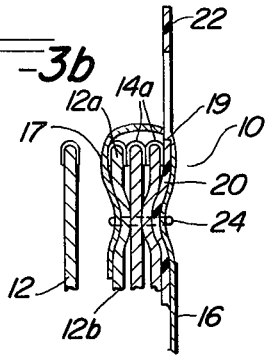
FIG-4
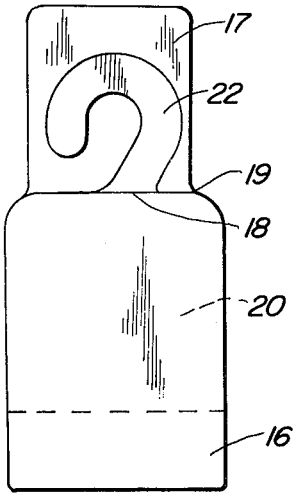

HAND WEARING APPAREL DISPLAY PACKAGE AND METHOD AND MACHINE FOR ASSEMBLY THEREOF

BACKGROUND OF THE INVENTION

The present invention relates to a hand wearing apparel display package and a method and apparatus for assembling the hand wearing apparel display package together.

In the past, it has been conventional practice to attach hand wearing apparel or gloves together with a tag or display package to display the hand wearing apparel on racks or hangers for customers to examine when purchasing the hand wearing apparel from a retailer. Generally, such hand wearing apparel packages separate the hand wearing apparel into pairs and affix to each pair a tag or label on which the size, advertising, the manufacturers' trademark and sales price of the hand wearing apparel is set forth. Such tags or labels on the hand wearing apparel have conventionally been composed of paper with a hole punched therein to permit hanging the bound hand wearing apparel onto a rack or hanger for display to the purchaser. See U.S. Pat. Nos. 2,682,122, 2,732,934 and 2,995,845 for examples of labeling tags or display packages in accordance with the prior art.

However, such labeling tags or display assemblies have presented several disadvantages. Generally, the tag assembly has been comprised of a paper liner which surrounds one hand wearing apparel or glove and the single outside surface of another hand wearing apparel or glove to permit the customer to fit the exposed glove for sizing during purchasing. This paper fold-over liner is stapled to the hand wearing apparel by driving a staple into and through the hand wearing apparel to attach the liner to the hand wearing apparel. The liner is adapted to hang on racks or hangers. However, it has been found that the paper liner package, after repeated handling by customers, oftentimes tears loose from the stapled hand wearing apparel or from the hanger. Also, when the customer purchases the hand wearing apparel, oftentimes in removing the staple from the hand wearing apparel, the portion of the apparel about the staple becomes damaged during removal. This problem is particularly evident when the hand wearing apparel is made of expensive leather or suede or when the apparel is sewn from a knitted, woven or plastic fabric material.

Also, when the hand wearing apparel is loosely stapled together in accordance with these prior art structures, the apparel may become separated and require matching and reassembling in order to affix the hand wearing apparel to the rack for display of the apparel. The time involved in operations of remating and relabeling the hand wearing apparel have been a further disadvantage to the retailer of these prior art packages.

Additionally, when such conventional paper display packages are mounted to hangers or racks, such labels frequently tear and result in the displayed hand wearing apparel or gloves dropping to the floor and becoming soiled and dirty, and oftentimes one hand becoming lost. Such problems have prevented the retailer from exhibiting hand wearing apparel or gloves to the customer in a proper and aligned manner.

SUMMARY OF THE INVENTION

It is one object of the present invention to provide an improved hand wearing apparel or glove hanger and display package having means for suspending the package on racks or hangers for display to customers.

It is a further object of the present invention to provide an improved hand wearing apparel or glove display package and means for assembly of such a package to the gloves which prevents damage to the gloves during disassembly of the gloves from the package.

It is still another object of the present invention to provide a method and multi-station machine assembly for assembling the hand wearing apparel display package of the present invention.

The hand wearing apparel display package of the present invention requires that the pair of gloves or wearing apparel be superimposed with respect to each other with the back of the left glove positioned against the front of the right glove and positioned for insertion into the assembly machine, as will hereinafter be described. As used herein, the term hand wearing apparel includes gloves, mittens or other type of hand wearing apparel. The glove display package in accordance with one embodiment of the present invention is comprised of a labeling tag or panel, which measures approximately three inches by six inches and which is narrowed along one end thereof for folding about the open ends of the gloves. The folding of the labeling tag or panel is accomplished when the narrow portion of the tag is extended over the edge ends of the right-hand glove and the edge end of the back portion of the left-hand glove that have been superimposed together. Preferably, the narrow folded part of the labling tag or panel will extend approximately one and a half inches into the left glove when positioned about the gloves. Also, the labeling tag or blank includes a laterally extending opening thereacross at the fold line into which a plastic hanger member is inserted, as will hereinafter be described.

The back part of the left-hand glove and the entire right-hand glove, with the narrow folded labeling tag extending into the left glove is positioned adjacent the fastener head of the glove and the outwardly extending plastic hanger is fitted about the gloves and a staple is driven through from the inside of the gloves outwardly through the plastic and the labeling tag. The staple is then turned and clenched to the inside to provide a secure glove display package.

It is preferred that the plastic hanger member of the glove display package extend outwardly through the labeling tag and above the attached gloves. However, it is within the scope of the present invention to directly attach the labeling tag to the outside surface of the plastic hanger member. In such an instance, the labeling tag does not extend into the left glove but is attached to the outside surface of the plastic hanger member. The hanger member may include a hook portion or opening therein for mounting the glove display package to a rack or hanger assembly for examination by a purchaser. The plastic hanger member of the glove display package is particularly useful in the present display package and prevents damage to the glove material surrounding the legs of the metal fasteners or staples, once the gloves have been stapled together. This occurs because the plastic hanger member serves as a device for straightening the legs of the metal staples or fasteners as the staple is removed from the gloves when the purchaser separates the gloves for use.

Additionally, during assembly of the gloves, the hanger member serves as a platen to guide the fasteners or staples through the layers of glove material during assembly of the package. Thus, the hanger member aids the ends of the metal fasteners in entering the layers of glove material, the hanger member and the labeling tag. Because the staple ends are turned and clenched to the inside on the outside of the plastic hanger member, the package assembly provides a cushioning effect to the stapled gloves and prevents tearing of the layers of glove material when the layers are fastened together.

It is a further embodiment of the present hand wearing apparel display package to include the use of plastic fasteners, made from nylon or other plastic material, for attaching the gloves together, in the same manner as described above with respect to the embodiment utilizing metal staples or fasteners. When utilizing a plastic fastener, the fastener head of the assembly machine includes a driver needle which prepunches a hole in the aligned layers of glove material, the plastic hanger member and labeling tag to permit insertion therethrough of the plastic fastener. Importantly, the plastic hanger member must be properly aligned and include an opening therein which is adapted to receive the plastic fastener which is inserted through the layers of glove material, the plastic hanger member and the labeling tag. After insertion, a horizontal release bar for releases and holds the hand wearing apparel display package together.

The multi-station machine or assembly for assembling the hand wearing apparel display package in accordance with the present invention preferably includes a four position turnwheel carriage comrpised of a first station positioned adjacent a labeling tag or blank supply hopper. The assembly includes mechanical fingers equipped with vacuum cups which predeterminedly grip and position a labeling tag from the supply hopper onto the first station of multi-station turnwheel carriage. Upon rotation and movement of the turnwheel carriage 90 degrees from this first position to a second position, a second labeling tag is taken from the supply hopper and positioned onto a second carriage member. Simultaneously, a plastic hanger member dispenser is engaged and positions the plastic hanger member onto the labeling tag or blank when the turntable assembly is in the second position. The turntable assembly and carriage is again rotated 90 degrees to a third or fastening station and positions the plastic hanger and labeling tag below a fastener head and above an anvil structure. The fastener head and the anvil cooperate together during attachment of the hand wearing apparel or gloves together. The right-hand glove and the back part of the left-hand glove are inserted between the anvil and fastener head and the operator positions the foldover portion of the labeling tag within the left-hand glove, aligns and positions the hanger member through the lateral opening of the labeling tag and staples the gloves together to complete the glove package assembly.

It should be recognized, however, that when a labeling tag is positioned and attached only to the outside of the hand wearing apparel display package, it is not necessary to fold the top portion of the labeling tag.

Thereafter, the turntable assembly is, preferably, again rotated 90 degrees to position the completed glove package assembly at a fourth station where the wearing apparel size, advertising, the manufacturer's trademark, sales price or the like may be affixed to the outside surface of the labeling tag. Importantly, as the assembly is rotated, the specific method of assembly of selecting and placing a labeling tag on the assembly at the first station, positioning the hanger member onto the labeling tag at the second station, fastening the hand apparel wearing package together at the third or fastening station and affixing indicia to the completed package at a fourth station is continuously occurring to provide the unique and novel hand wearing apparel package and assembly in accordance with the present invention.

DESCRIPTION OF THE DRAWINGS

FIGS. 2*a*, 2*b* and 2*c* are front elevational views of the hanger plate member in accordance with one embodiment of the present invention;

FIG. 3*a* is a cross-sectional view of the glove display package in accordance with one embodiment of the present invention;

FIG. 3*b* is a cross-sectional view of the glove display package in accordance with a further embodiment of the present invention; and FIG. 4 is a front elevational view showing the positioning of the hanger plate member through the labeling tag in the embodiment of the hand wearing apparel display package as shown in FIG. 3*b*.

DETAILED DESCRIPTION

Figure 1:
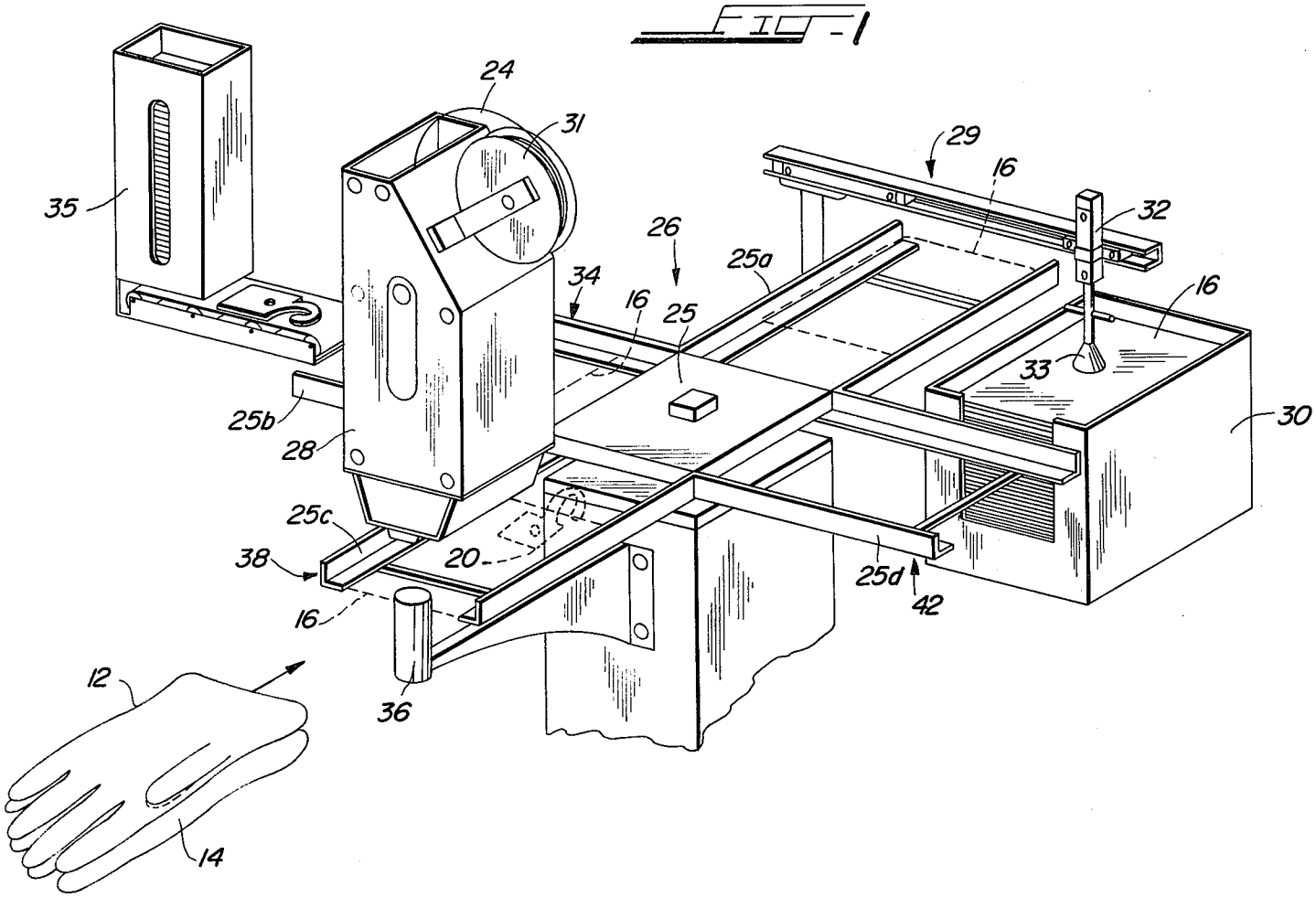
FIG. 1 is a schematic view of a multi-station assembly for assembling the hand wearing apparel display package in accordance with the present invention.

Referring now to the drawings wherein like numerals have been used throughout to indicate the same or similar parts, FIG. 3*b* describes the one embodiment of hand wearing apparel or glove display package 10 in accordance with the present invention. The display package 10 requires that a pair of gloves, or other types of hand wearing apparel, such as mittens, including a left-hand glove 12 and a right-hand glove 14, as shown in FIG. 1, be superimposed with respect to each other with the palm facing the back. As shown in FIGS. 3*b* and 4, the glove display package 10 in accordance with one embodiment of the present invention is comprised of a labeling tag or panel 16 which measures approximately 3 inches by 6 inches and which is narrowed along one end 17 thereof for folding about the ends 12*a* and 14*a* of the pair of gloves. Preferably, the narrow folded end portion 17 of the labeling tag 16 includes a laterally extending opening 18 thereacross at the foldline 19, which opening is adapted to receive a portion of a plastic hanger member 20, as shown in FIG. 4.

In such an embodiment, the plastic hanger member 20 extends outwardly through the laterally extending opening 18 of the labeling tag 16 and that such an extension of the hanger member includes a hook portion or opening 22, as shown in FIGS. 2*a*–2*c*, which hook portion or opening is adapted to engage a rack or hanger assembly for mounting the glove display package for examination by a purchaser.

To complete the hand wearing apparel display package 10, as shown in FIG. 3*b*, the back panel 12*b* of the left-hand glove 12 and the entire front and back panels of the right-hand glove 14 are held together and the plastic hanger member, extending through the labeling tag and the labeling tag are moved adjacent the ends 12*a* and 14*a* of the glove and the end portion 17 of the labeling tag 16 is folded over and inserted approximately one to two inches into the left-hand glove 12. The folding of the labeling tag 16 occurs at approximately the foldline 19 of the labeling tag and is accomplished when the narrow end portin 17 of the tag is extended over the edge ends of the right-hand glove and the edge end of the back panel of the left-hand glove that have been superimposed together. Generally, the narrow folded end portion 17 of the labeling tag will extend approximately one and one half inches into the left glove 12, when positioned about the glove.

When the right-hand glove 14 and the entire left-hand glove with the narrow folding labeling tag extending therein are so positioned, the package is fastened together by driving a metallic wire or staple 24 from the inside of the left-hand glove outwardly through the end portion of the labeling tag and then through the back panel 12*b* of the left-hand glove, through the both panels of the right-hand glove and finally through the hanger member 20 and labeling tag 16. When the staple or wire exits the labeling tag 16, it is turned inwardly and clenched towards the inside to provide the secure hand wearing apparel or glove display package 10 in accordance with the present invention.

It is preferred that the staple or wire 24 extend outwardly through the plastic hanger member and labeling tag and not into the back panel 12*b* of the left-hand glove because when a customer selects a glove, it is necessary to utilize the left-hand glove 12 to permit the customer to fit the glove to the hand. If the staple or wire ends are extending into the left-hand glove, the staple or wire ends fastener could become lose and injure the customer's hand during this fitting operation. Also, the plastic hanger member 20 is particularly useful in the present display package because it prevents damage to the glove material located about the legs of the metal fasteners or staples, once the gloves have been stapled together in the display package. This occurs because the hanger member 20 serves as a device for straightening the legs or extensions of the metal staple or fasteners which extend through the glove package as the staple is removed from the gloves by the customer when separating the gloves for usage. Because the present invention is useful with a wide variety of knitted and special leather type hand wearing apparel, the elimination of damage to the leather or fabric of the hand wearing apparel or glove is very important.

Also, during assembly of the hand wearing apparel or glove package, the hanger member 20 serves as a platen to guide the fasteners or staples through the layers of glove material during assembly of the package. The hanger member aids and assists the ends of the metal fasteners in entering the layers of glove material, the hanger plate and labeling tag, and because the ends of the fasteners are turned inwardly and clenched to the inside on the outside of the plastic hanger member, the display package provides a cushioning effect to the stapled gloves and prevents tearing of the layers of glove material when the layers are fastened together.

In FIG. 3*a*, another embodiment of the hand wearing apparel display package 10 is shown and includes the use of a plastic fastener 24 made from nylon or other plastic material for attaching the gloves together. The attachment of the left-hand glove and right-hand glove is in the same manner as described above with respect to the embodiment utilizing metal wire or staples, except that when the plastic fastener is utilized, the fastening head 28 of an assembly machine 26 includes a driver needle (not shown) which prepunches a hole in the aligned layers of glove material, the plastic hanger member 20 and the labeling tag 16 to permit insertion therethrough of the plastic fastener 24. In such an instance, the plastic hanger member 20 must include openings 21 therein, as shown in FIGS. 2*a*–2*c* to permit and receive the plastic fastener which is inserted through the layers of glove material during packaging. After insertion therethrough, the ends of the plastic fastener, a horizontal release bar (partially shown a 27), holds the package assembly together.

As schematically shown in FIG. 1, a multi-station machine or assembly 26 for assembling the glove display package in accordance with the present invention preferentially includes a four position turnwheel carriage 25*a*–25*d* comprised of a first work station 29 positioned adjacent a labeling tag or blank supply hopper 30. The assembly machine 26 includes mechanical fingers 32 equipped with vacuum cups 33 which predeterminedly grip and position a labeling tag 16 from the supply hopper 30 onto the first work station 29 of the multi-station turnwheel carriage 25. Upon rotational movement 90 degrees of the turnwheel carriage 90 degrees from this first position 29 to a second work position or station 34, a second labeling tag 16 is taken from the supply hopper 30 and positioned onto a second carriage member 25. Simultaneously, a plastic hanger member dispenser 35 is engaged and positions the plastic hanger member 20 onto the labeling tag 16. The turnwheel carriage 25 is then rotated 90 degrees to a third or fastening work station 38 wherein the plastic hanger and labeling tag are positioned below a fastening head 28 and above an anvil 36. The fastening head 28 and the anvil 36 cooperate together during attachment of the gloves to complete the packaging assembly. As shown in FIG. 1, the fastening head 28 includes a supply roll 31 of plastic material 27, as desired, for completing the securing of the display package together. However, it is within the scope of the present invention to utilize a stapling device in place of the fastening head 28 to provide the hand wearing apparel display package as shown in FIG. 3*b*.

To complete the glove package, as shown in FIG. 1, the right-hand glove 14 and the back panel of the left-hand glove 12 are inserted between the anvil 36 and fastener head 28. When completing the package assembly as shown in FIG. 3*b*, the operator positions the foldover portion 17 of the labeling tag 16 within the left-hand glove. Extending outwardly through the lateral opening 18 in the tag is the hook portion 22 of the hanger member 20, as shown in FIG. 4. The operator folds back the top portion of the left-hand glove and positons the unsecured package over the anvil in alignment with the fastener head. Upon actuation of the fastener element or head 28, a staple 24 (FIG. 3*b*) or plastic fastener 24 (FIG. 3*a*) is driven through the layers of glove material, the layers of the labeling tag and the hanger member to secure and complete the glove package. It should be noted that the scope of the present invention is such to include the utilization of both types of fasteners, plastic or metal staples, in both types of package assemblies, as shown in FIG. 3*d* where the labeling tag is affixed to the outside of the hanger member 30 and in FIG. 3*b* where the hanger member is inserted through the lateral opening 18 and the foldover portion 17 is inserted within the glove ends.

Thereafter, the turntable assembly is, preferably, again rotated 90 degrees to position the completed glove package assembly 10 at a fourth station 42 where the wearing apparel size, advertising, the manufacturer's trademark, sales price or the like may be affixed to the outside surface of the labeling tag. Importantly, as the assembly is rotated, the specific method of assembly of selecting and placing a labeling tag on the assembly at the first station 29, positioning the hanger member onto the labeling tag at the second station 34, fastening the hand wearing apparel package together at the third station 38 and affixing indicia to the completed package at a fourth station 42 is continuously occurring at each station to provide the unique and novel hand wearing apparel package and assembly in accordance with the present invention.

Thus, while I have described the invention in connection with specific embodiments, it is to be understood that these are capable of variation and modification, and I do not wish to be limited to the precise details set forth, but desire to avail myself of such changes and modifications as fall within the purview of the appended claims.

I claim:

1. A hand wearing apparel display package having left-hand and right-hand apparel members each comprised of front and back panel portions including in combination, left-hand and right-hand apparel members superimposed with respect to each other with the palm facing the back, a plastic hanger member positioned adjacent the back panel of one of the hand apparel members along the open end thereof, a labeling tag positioned on the outside surface of said plastic hanger member and superimposed thereon, and metal stapling means extending through the back portion of one of said hand apparel members and through said plastic hanger member and said labeling tag with the ends of said stapling means turned inwardly and clenched to the inside on the outside surface of said plastic hanger to secure the hand apparel members together to provide a cushioning effect to the stapled hand apparel members to complete the display package and which prevents tearing of the hand apparel members during removal and of the members from the display package.

2. The display package in accordance with claim 1 wherein said plastic hanger member includes a hook extension portion thereon for attachment of the display package onto a rack for display.

3. The display package in accordance with claim 1 wherein said fastening means is a plastic fastener and said hanger member includes an aligned opening therein to permit insertion therethrough of said plastic fasteners to complete the display package.

4. The display package in accordance with claim 2 wherein said labeling tag includes a narrowed end portion and a laterally extending opening therein, with said hook extension portion of said hanger member extending through said laterally extending opening in said labeling tag and said narrowed end portion foldable about the back portion of one of said hand wearing members and the front and back portions of the other of said hand wearing members and secured thereto by said fastening means to complete the display package.

5. A hand-wearing apparel display package having left-hand and right-hand apparel members each comprised of front and back panel portions including in combination:

left-hand and right-hand apparel members superimposed with respect to each other, a plastic hanger member positioned adjacent to the back panel of one of the hand apparel members along the open end thereof, and metal stapling means extending through the back portion of one of said hand apparel members and through at least one of said front and back portions of the other of said hand apparel members and through said plastic hanger member with the ends of said metal stapling means turned inwardly and clenched to the inside on the outside surface of said plastic hanger to secure said hand apparel members together to provide a cushioning effect to the stapled hand apparel members to complete the display package and which prevents tearing of the hand apparel members during the removable of the members from the display package.

* * * * *

UNITED STATES PATENT AND TRADEMARK OFFICE

CERTIFICATE OF CORRECTION

PATENT NO. : 4,485,917

DATED : December 4, 1984

INVENTOR(S) : Jasper N. Smith

It is certified that error appears in the above—identified patent and that said Letters Patent is hereby corrected as shown below:

Col. 3, line 25: delete "for";

line 31: change "comrpised" to --comprised--;

Col. 4, line 68: change "portin" to --portion--;

Col. 5, line 27: change "lose" to --loose--;

Col. 6, line 5: change "a 27" to --at 24--;

line 57: change "3d" to --3a--;

line 59: change "30" to --20--;

Col. 8, line 40: change "removable" to --removal--.

Signed and Sealed this

*Twenty-third* Day of *July 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,485,917

DATED : December 4, 1984

INVENTOR(S) : Jasper N. Smith

It is certified that error appears in the above-identified patent and that said Letters Patent is hereby corrected as shown below:

Column 7, line 42: delete "and".

Signed and Sealed this

Twenty-seventh Day of October, 1987

*Attest:*

DONALD J. QUIGG

*Attesting Officer*

*Commissioner of Patents and Trademarks*